US011028741B1

(12) United States Patent
Joughin et al.

(10) Patent No.: US 11,028,741 B1
(45) Date of Patent: Jun. 8, 2021

(54) OIL PICK-UP ASSEMBLY

(71) Applicant: APQ Development, LLC, Jackson, MI (US)

(72) Inventors: Justin Joughin, Morenci, MI (US); Lee McLain, Jonesville, MI (US)

(73) Assignee: APQ Development, LLC, Jackson, MI (US)

( * ) Notice: Subject to any disclaimer, the term of this patent is extended or adjusted under 35 U.S.C. 154(b) by 0 days.

(21) Appl. No.: 17/001,215

(22) Filed: Aug. 24, 2020

(51) Int. Cl.
*F01M 11/00* (2006.01)

(52) U.S. Cl.
CPC ... *F01M 11/0004* (2013.01); *F01M 2011/007* (2013.01)

(58) Field of Classification Search
CPC ..... F01M 11/0004; F01M 2011/007
See application file for complete search history.

(56) References Cited

U.S. PATENT DOCUMENTS 1,369,239 A 2/1921 Gullick
1,399,943 A 12/1921 Dunham
1,421,440 A 7/1922 Fisher
1,800,585 A 4/1931 Woolson
2,440,815 A 5/1948 Wharam et al.
3,211,256 A 10/1965 Teutsch
3,504,769 A 4/1970 Mettig
3,509,861 A 5/1970 Deutschmann et al.
3,592,293 A 7/1971 Frincke
3,773,144 A 11/1973 Hummel
3,904,528 A 9/1975 Yocum
4,021,344 A 5/1977 Webb
4,056,168 A 11/1977 Bajohr
4,129,503 A 12/1978 Joseph
4,179,379 A 12/1979 Mitchell
4,224,161 A 9/1980 Anderson et al.
4,351,550 A 9/1982 Anderson et al.
4,417,383 A 11/1983 Anderson et al.
4,616,610 A 10/1986 Ishida
4,768,936 A 9/1988 Etemad et al.
4,804,466 A 2/1989 Cooper et al.
4,828,694 A 5/1989 Leason
4,889,621 A * 12/1989 Yamada ..... B01D 29/05 210/167.08
4,930,469 A 6/1990 Kamprath et al.
5,049,274 A 9/1991 Leason et al.
5,088,579 A 2/1992 Kim et al.
(Continued)

*Primary Examiner* — Minh Truong
(74) *Attorney, Agent, or Firm* — Honigman LLP; Brett A. Krueger

(57) ABSTRACT

An oil pick-up assembly includes an upper housing having an upper shell extending from a first end of the assembly to a second end of the assembly. The upper shell defines a mounting plane of the assembly. The upper housing further includes an upper peripheral flange surrounding the upper shell. The oil pick-up assembly also a lower housing having a lower shell extending from the first end of the assembly to the second end of the assembly. The lower shell includes a first portion adjacent to the first end and substantially parallel to the mounting plane and a second portion adjacent to the second end and formed at a first oblique angle relative to the mounting plane. The lower shell also includes a lower peripheral flange surrounding the lower shell, the lower peripheral flange of attached to the upper peripheral flange of the upper housing to form a chamber.

18 Claims, 12 Drawing Sheets

(56) References Cited

U.S. PATENT DOCUMENTS 5,099,954 A 3/1992 Kikuchi et al.
5,130,014 A 7/1992 Volz
5,176,174 A 1/1993 Toraason et al.
5,377,781 A 1/1995 Yun
5,452,693 A 9/1995 Clark
5,531,196 A 7/1996 Clark
5,538,633 A 7/1996 Kitajima et al.
5,863,081 A 1/1999 Katayama et al.
5,988,134 A 11/1999 Smietanski
6,041,752 A 3/2000 Van Klompenburg
6,142,257 A 11/2000 Bruener et al.
6,165,373 A 12/2000 Agner
6,190,546 B1 2/2001 Agner
6,257,193 B1 7/2001 Alpan et al.
6,260,534 B1 7/2001 Kampichler et al.
6,289,865 B1 9/2001 Spix
6,428,699 B1 * 8/2002 Iwata ..... B29C 65/20 210/167.02
6,478,114 B2 11/2002 Ito et al.
6,484,846 B1 11/2002 Parker
6,520,293 B1 2/2003 Ogawa et al.
6,523,561 B2 2/2003 Kapcoe et al.
6,524,476 B1 2/2003 Caiozza
6,539,912 B1 4/2003 Beer
6,584,950 B1 7/2003 Cunningham
6,640,769 B2 11/2003 Nomura et al.
6,742,490 B2 6/2004 Meisner
6,796,283 B1 9/2004 Fleury et al.
6,811,383 B2 11/2004 Maier
6,845,743 B1 1/2005 Bishop
7,047,927 B2 5/2006 Hashimoto et al.
7,096,845 B1 8/2006 Vaandrager et al.
7,124,730 B2 10/2006 Schwarzl et al.
7,128,218 B2 10/2006 Rosendahl et al.
7,140,934 B2 11/2006 Hoi
7,171,937 B2 2/2007 Hada et al.
7,210,562 B2 5/2007 Morii et al.
7,261,079 B2 8/2007 Gunji et al.
7,270,104 B2 9/2007 Hashimoto et al.
7,383,809 B2 6/2008 Rosendahl et al.
7,398,858 B2 7/2008 Bicker et al.
7,418,938 B2 9/2008 Hashimoto et al.
7,422,021 B2 9/2008 Leaphart
7,451,736 B2 11/2008 Migaud et al.
7,478,618 B2 1/2009 Hashimoto et al.
7,571,705 B2 8/2009 Inaba
7,655,078 B2 2/2010 Saito et al.
7,681,890 B2 3/2010 Griffin et al.
7,748,500 B2 7/2010 Nagano et al.
7,757,656 B2 7/2010 Hoi et al.
7,767,084 B2 8/2010 Jinbo et al.
7,841,313 B2 11/2010 Hashimoto et al.
7,878,085 B2 2/2011 Keyaki et al.
7,922,005 B2 4/2011 Haladyna
7,958,861 B2 6/2011 Klumpp et al.
7,992,534 B2 8/2011 Hashimoto et al.
8,011,340 B2 9/2011 Bicker et al.
8,011,342 B2 9/2011 Bluhm
8,038,877 B2 10/2011 Stausberg et al.
8,066,100 B2 11/2011 Mori et al.
8,075,772 B2 12/2011 Suga
8,113,167 B2 2/2012 Jessberger et al.
8,125,601 B2 2/2012 Kim et al.
8,146,561 B2 4/2012 Pryor et al.
8,157,105 B2 * 4/2012 Nishiyama ..... F16H 57/0404 210/435
8,297,251 B2 10/2012 Asaya
8,297,407 B2 10/2012 Mori et al.
8,336,515 B2 12/2012 Jainek et al.
8,408,401 B2 * 4/2013 Tawa ..... F01M 11/03 210/416.5
8,443,777 B2 5/2013 Enokida
8,464,683 B2 6/2013 Hashimoto et al.
8,635,983 B2 1/2014 Enokida
8,673,141 B2 3/2014 Stausberg et al.
8,734,642 B2 5/2014 Fauchet
8,893,896 B2 11/2014 Nishikawa
9,028,221 B2 5/2015 Hritz
9,353,851 B2 5/2016 Kubota et al.
9,376,942 B2 6/2016 Noguchi et al.
9,441,746 B2 9/2016 Borlon et al.
9,567,880 B2 2/2017 Shieh et al.
9,573,085 B2 2/2017 Beer et al.
9,604,163 B2 3/2017 Hatae et al.
9,677,436 B2 6/2017 Mordukhovich
9,719,460 B2 8/2017 Kong et al.
9,719,463 B2 8/2017 Oltmans et al.
9,771,840 B2 9/2017 Zahdeh
9,784,149 B2 10/2017 Matsuda et al.
9,903,241 B2 2/2018 Hellman et al.
9,944,374 B1 4/2018 Anderson et al.
9,964,011 B2 5/2018 Mukohara
10,086,318 B2 10/2018 Eleftherakis et al.
10,113,458 B2 10/2018 Takatsugi
10,132,215 B2 11/2018 Nagai et al.
10,167,753 B2 1/2019 Mukohara et al.
10,227,903 B2 3/2019 Viola et al.
10,247,065 B2 4/2019 Mercier
10,260,387 B2 4/2019 Kong et al.
10,294,889 B2 5/2019 Oltmans et al.
D852,319 S 6/2019 Hellman et al.
10,344,640 B2 7/2019 Miyamura et al.
10,359,015 B2 7/2019 Pinault
10,371,249 B1 8/2019 Bluhm et al.
10,385,741 B2 8/2019 Petridis et al.
10,494,962 B2 12/2019 Yuki et al.
10,494,964 B2 12/2019 Heckman et al.
10,508,571 B2 12/2019 Blundy
10,570,788 B2 2/2020 Bennett et al.
10,677,343 B2 6/2020 Howard et al.
10,695,883 B2 6/2020 Hugel
10,724,406 B2 7/2020 Hellman et al.
2002/0007984 A1 1/2002 Ito et al.
2002/0096221 A1 7/2002 Kapcoe et al.
2003/0037758 A1 2/2003 Nomura et al.
2003/0152464 A1 8/2003 Maier
2004/0007520 A1 1/2004 Rosendahl et al.
2004/0060533 A1 4/2004 Meisner
2004/0000842 A1 5/2004 Morii et al.
2004/0141128 A1 7/2004 Kim et al.
2004/0231924 A1 11/2004 Schwarzl et al.
2005/0268877 A1 12/2005 Hashimoto et al.
2005/0279314 A1 12/2005 Hada et al.
2005/0281693 A1 12/2005 Roberts
2006/0068656 A1 3/2006 Hoi
2006/0137940 A1 6/2006 Gunji et al.
2006/0180116 A1 8/2006 Vaandrager et al.
2006/0191506 A1 8/2006 Hashimoto et al.
2006/0219620 A1 10/2006 Suga
2007/0017745 A1 1/2007 Rosendahl et al.
2007/0062562 A1 3/2007 Leaphart
2007/0163442 A1 7/2007 Saito et al.
2007/0163937 A1 * 7/2007 Sato ..... B01D 35/02 210/232
2007/0221447 A1 9/2007 Bicker et al.
2007/0272194 A1 11/2007 Hoi et al.
2007/0272195 A1 11/2007 Keyaki et al.
2007/0289569 A1 12/2007 Migaud et al.
2008/0011260 A1 1/2008 Hashimoto et al.
2008/0017158 A1 1/2008 Hashimoto et al.
2008/0047521 A1 2/2008 Koyama
2008/0078352 A1 4/2008 Inaba
2008/0210491 A1 9/2008 Mori et al.
2008/0216789 A1 9/2008 Hashimoto et al.
2008/0237111 A1 10/2008 Haladyna
2008/0264727 A1 10/2008 Nagano et al.
2008/0283020 A1 11/2008 Bicker et al.
2008/0290013 A1 11/2008 Stausberg et al.
2009/0045129 A1 2/2009 Jinbo et al.
2009/0139482 A1 6/2009 Bicker et al.
2009/0230049 A1 9/2009 Stausberg et al.
2009/0301954 A1 12/2009 Beer et al.
2010/0012074 A1 1/2010 Asaya
2010/0012075 A1 1/2010 Bluhm

(56) References Cited

U.S. PATENT DOCUMENTS

2010/0037849 A1 2/2010 Jainek et al.
2010/0108019 A1 5/2010 Klumpp et al.
2010/0133164 A1 6/2010 Nishikawa
2010/0162988 A1 7/2010 Enokida
2010/0212623 A1 8/2010 Jessberger et al.
2010/0224450 A1 9/2010 Dods et al.
2010/0300395 A1 12/2010 Enokida
2011/0067666 A1 3/2011 Hashimoto et al.
2011/0253091 A1 10/2011 Hashimoto et al.
2012/0037456 A1 2/2012 Mori et al.
2012/0073527 A1 3/2012 Oltmans et al.
2012/0073537 A1 3/2012 Oltmans et al.
2012/0085689 A1 4/2012 Fauchet
2012/0210971 A1 8/2012 Noguchi et al.
2012/0234741 A1 9/2012 Hritz
2012/0305469 A1 12/2012 Stausberg et al.
2014/0116931 A1 5/2014 Beer et al.
2014/0166401 A1 6/2014 Kubota et al.
2014/0197085 A1 7/2014 Stausberg et al.
2014/0373939 A1 12/2014 Borlon et al.
2015/0028038 A1 1/2015 Franz
2015/0090216 A1 4/2015 Hatae et al.
2015/0096527 A1 4/2015 Kong et al.
2015/0096840 A1 4/2015 Kong et al.
2015/0114897 A1 4/2015 Eleftherakis et al.
2015/0129471 A1 5/2015 Beer et al.
2015/0129727 A1 5/2015 Marsar et al.
2015/0136064 A1 5/2015 Matsuda et al.
2015/0247431 A1* 9/2015 Yuki ..... B01D 35/0273 210/435
2015/0300220 A1 10/2015 Mordukhovich
2016/0245135 A1 8/2016 Zandeh
2016/0245136 A1 8/2016 Takatsugi
2016/0281555 A1 9/2016 Nagai et al.
2016/0319714 A1 11/2016 Shieh et al.
2016/0319715 A1 11/2016 Shieh et al.
2017/0138232 A1 5/2017 Hellman et al.
2017/0218802 A1 8/2017 Takano
2017/0268393 A1 9/2017 Pekarsky et al.
2017/0276036 A1 9/2017 Mukohara et al.
2017/0276038 A1 9/2017 Mukohara
2017/0362972 A1 12/2017 Mercier
2017/0368656 A1 12/2017 Hugel
2017/0370336 A1 12/2017 Pinault
2018/0031107 A1 2/2018 Howard et al.
2018/0135477 A1 5/2018 Hellman et al.
2018/0135478 A1 5/2018 Blundy
2018/0202330 A1 7/2018 Petridis et al.
2018/0283244 A1 10/2018 Fujinuma et al.
2018/0283245 A1 10/2018 Miyamura et al.
2018/0298797 A1 10/2018 Heckman et al.
2018/0334934 A1 11/2018 Hellman et al.
2018/0347415 A9 12/2018 Mercier
2018/0347420 A1 12/2018 Bedi et al.
2019/0024544 A1 1/2019 Viola et al.
2019/0072014 A1 3/2019 Hutchins
2019/0072015 A1 3/2019 Hutchins
2019/0128155 A1 5/2019 Bennett et al.
2019/0264589 A1 8/2019 Lechartier et al.
2019/0264635 A1 8/2019 Oltmans et al.
2019/0285161 A1 9/2019 Rosendahl et al.
2020/0049035 A1 2/2020 Feng et al.
2020/0116052 A1 4/2020 Pekarsky et al.
2020/0116053 A1 4/2020 Blundy
2020/0149446 A1 5/2020 Owaki
2020/0182109 A1 6/2020 Shen et al.

* cited by examiner

OIL PICK-UP ASSEMBLY

TECHNICAL FIELD

This disclosure relates to an oil pick-up assembly.

BACKGROUND

Oil pick-up tubes are used in the sump of internal combustion engines and other assemblies that require lubrication. In internal combustion engine applications, the oil pick-up tube is disposed within an oil pan and includes an inlet portion disposed within a well of the oil pan for drawing oil into the engine. As automobiles continue to evolve in design, packaging requirements for the oil pan and oil pick-up tubes have become more stringent.

SUMMARY

One aspect of the disclosure provides an oil pick-up assembly for a motor vehicle. The oil pick-up assembly includes an upper housing having an upper shell extending from a first end of the assembly to a second end of the assembly. The upper shell defines a mounting plane of the assembly. The upper housing further includes an upper peripheral flange surrounding the upper shell. The oil pick-up assembly also a lower housing having a lower shell extending from the first end of the assembly to the second end of the assembly. The lower shell includes a first portion adjacent to the first end and substantially parallel to the mounting plane and a second portion adjacent to the second end and formed at a first oblique angle relative to the mounting plane. The lower shell also includes a lower peripheral flange surrounding the lower shell, the lower peripheral flange of attached to the upper peripheral flange of the upper housing to form a chamber.

Implementations of the disclosure may include one or more of the following optional features. In some implementations, the lower housing includes a pick-up tube extending from the second portion at a second oblique angle relative to the mounting plane. Here, the pick-up tube extends continuously along a longitudinal axis extending from a proximal end connected to the second portion of the lower shell to a distal end. Optionally, the pick-up tube tapers from the first end to the second end.

In some implementations, the upper housing includes an outlet tube extending from the second end, the outlet tube having a central axis that is parallel to the mounting plane. In some examples, the first portion of the lower shell is connected to the second portion of the lower shell by an arcuate intermediate portion.

In some configurations, a portion of the upper peripheral flange that surrounds the upper shell extends along the second end of the assembly at a third oblique angle relative to the mounting plane. Here, a value of the third oblique angle is the same as a value of the first oblique angle.

In some configurations, the upper peripheral flange is welded to the lower peripheral flange. Optionally, the upper housing includes at least one mounting tab extending from the upper shell, and the at least one mounting tab includes a mounting surface defining the mounting plane of the upper housing.

Another aspect of the disclosure provides method of manufacturing an oil pick-up assembly for a motor vehicle. The method includes forming an upper housing including an upper shell extending from a first end to a second end and an upper peripheral flange surrounding the upper shell, where the upper shell defines a mounting plane of the assembly. Another step of the method includes forming a lower housing including a lower shell extending from the first end to the second end and a lower peripheral flange surrounding the lower shell. The lower peripheral flange of the lower housing is attached to the upper peripheral flange of the upper housing to form a chamber. The lower shell includes a first portion adjacent to the first end and substantially parallel to the mounting plane, and a second portion adjacent to the second end and formed at a first oblique angle relative to the mounting plane. In another step, the method includes attaching the upper peripheral flange of the upper housing to the lower peripheral flange of the lower housing.

This aspect may include one or more of the following optional features. In some examples, forming the lower housing includes forming a pick-up tube extending from the second portion at a second oblique angle relative to the mounting plane. In some implementations, forming the pick-up tube includes extending the pick-up tube continuously along a longitudinal axis from a proximal end connected to the second portion of the lower shell to a terminal distal end. Here, forming the pick-up tube comprises tapering the pick-up tube.

In some examples, forming the upper housing includes forming an outlet tube extending from the second end, the outlet tube having a central axis that is parallel to the mounting plane. In some implementations, forming the lower shell comprises forming an arcuate intermediate portion connecting the first portion of the lower shell to the second portion of the lower shell.

In some configurations, forming the upper housing includes forming a portion of the upper peripheral flange that surrounds the upper shell to extend along the second end of the assembly at a third oblique angle relative to the mounting plane. Here, a value of the third oblique angle is the same as a value of the first oblique angle.

In some examples, attaching the upper peripheral flange of the upper housing to the lower peripheral flange of the lower housing includes welding the upper peripheral flange to the lower peripheral flange. Optionally, forming the upper housing includes forming at least one mounting tab extending from the upper shell, and forming the at least one mounting tab with a mounting surface defining the mounting plane of the upper housing.

The details of one or more implementations of the disclosure are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

Figure 1:
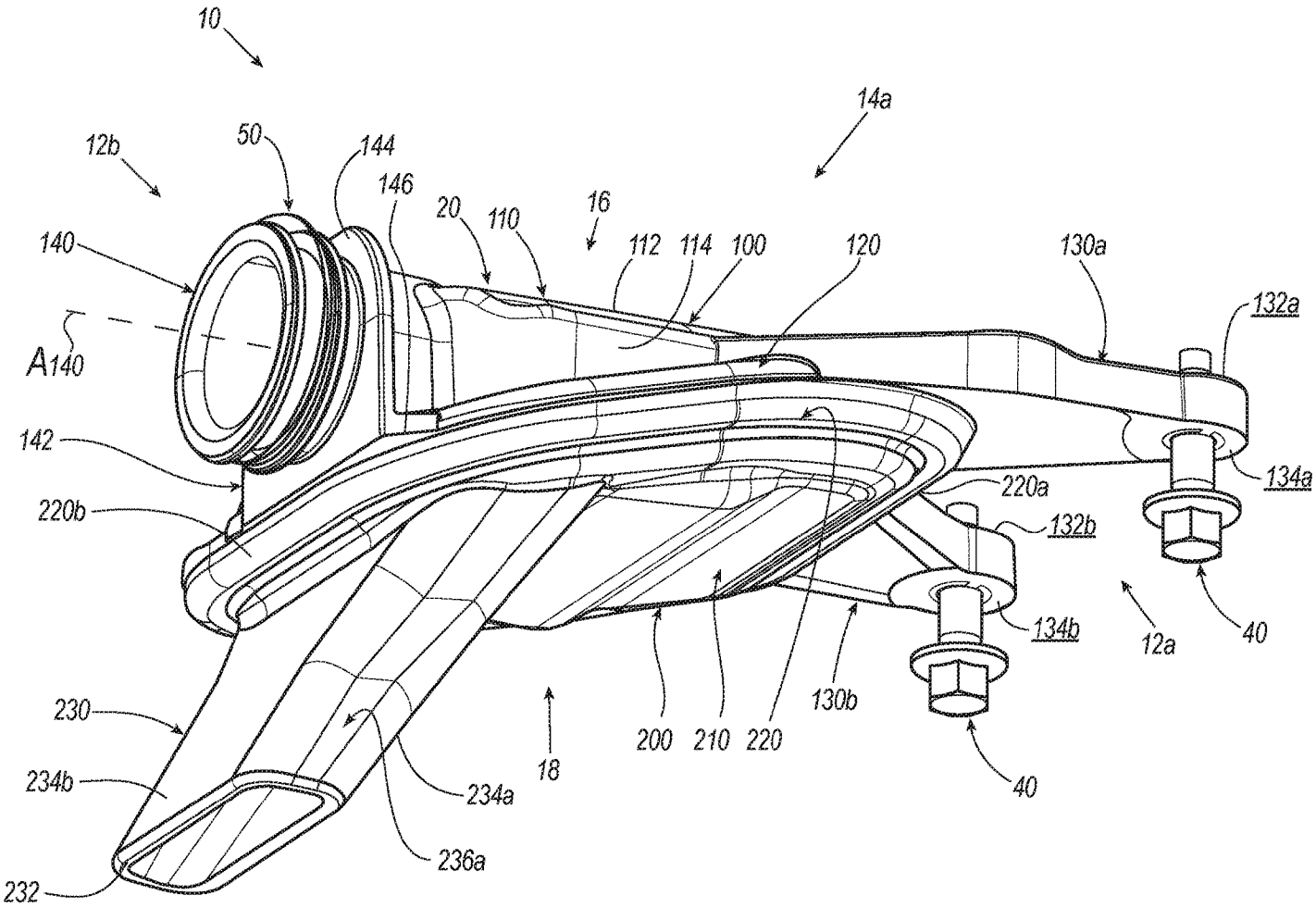
FIG. 1 is bottom-rear perspective view of an example of oil pick-up assembly.

Referring to FIGS. 1-12, an oil pick-up assembly 10 for an internal combustion engine (not shown) is provided. As described throughout this application, the assembly 10, and features thereof, may be described as extending from a first end 12*a* to a second end 12*b* disposed at an opposite end of the assembly 10 than the first end 12*a*. The assembly 10 also includes a pair of sides 14*a*, 14*b* each extending from the first end 12*a* to the second end 12*b*. Additionally, the assembly 10 may be described as including a top side 16 and a bottom side 18 disposed on an opposite side of the assembly 10 than the top side 16.

The assembly 10 includes an upper housing 100 and a lower housing 200 that cooperate to define an internal chamber or reservoir 20 of the assembly 10, which receives and contains a volume of oil while the engine is in operation. Generally, the assembly 10 is configured to draw oil from within an oil pan (not shown) of the engine and to supply the oil the engine block for lubrication and cooling of components (e.g., crankshaft, pistons, connecting rods) of a powertrain of the engine. The assembly 10 of the present disclosure is configured to optimize a flow of the oil from the oil pan to the engine block.

Figure 7:
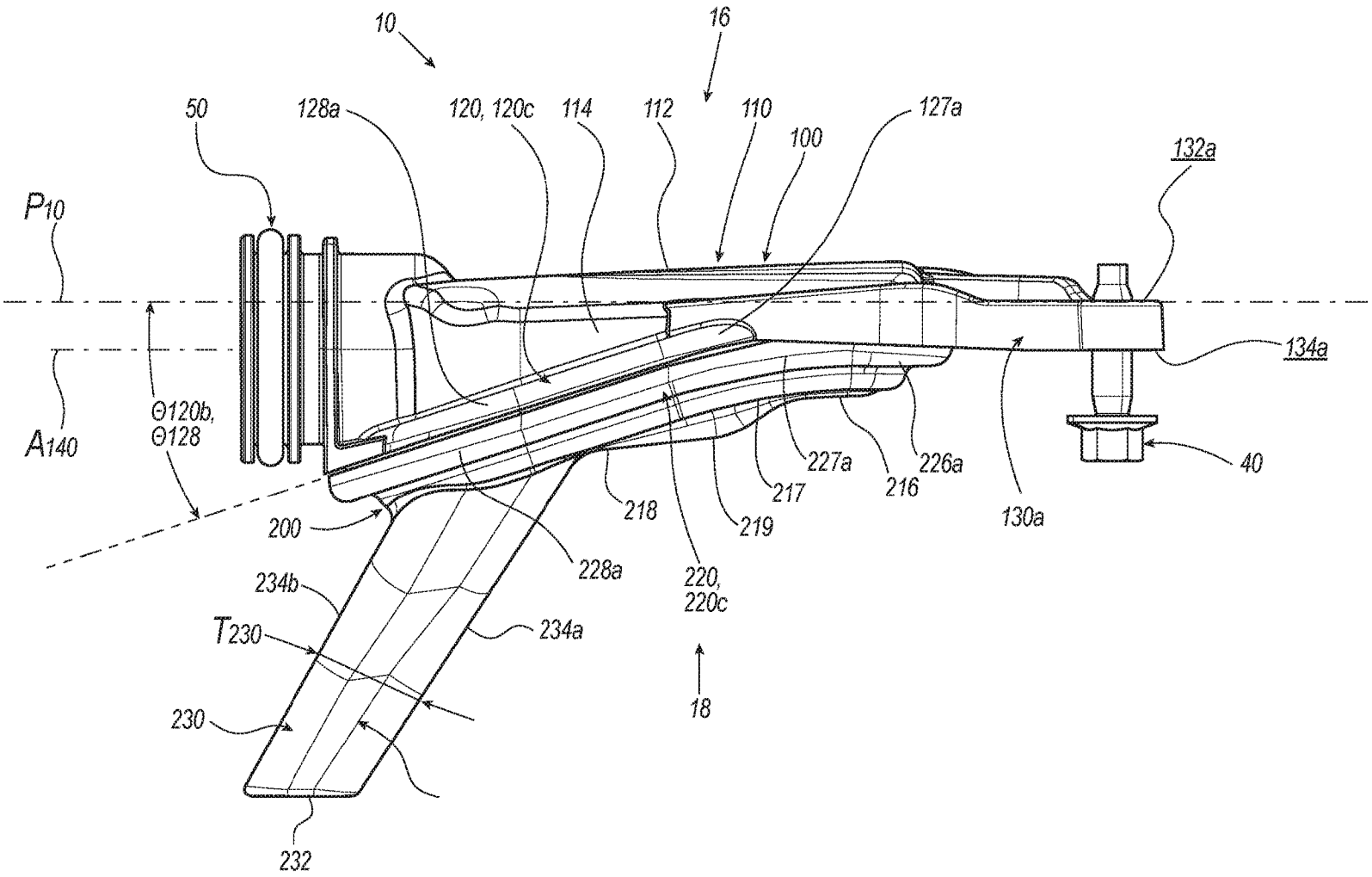
FIG. 7 is a right side elevation view of the oil pick-up assembly of FIG. 1.
Figure 8:
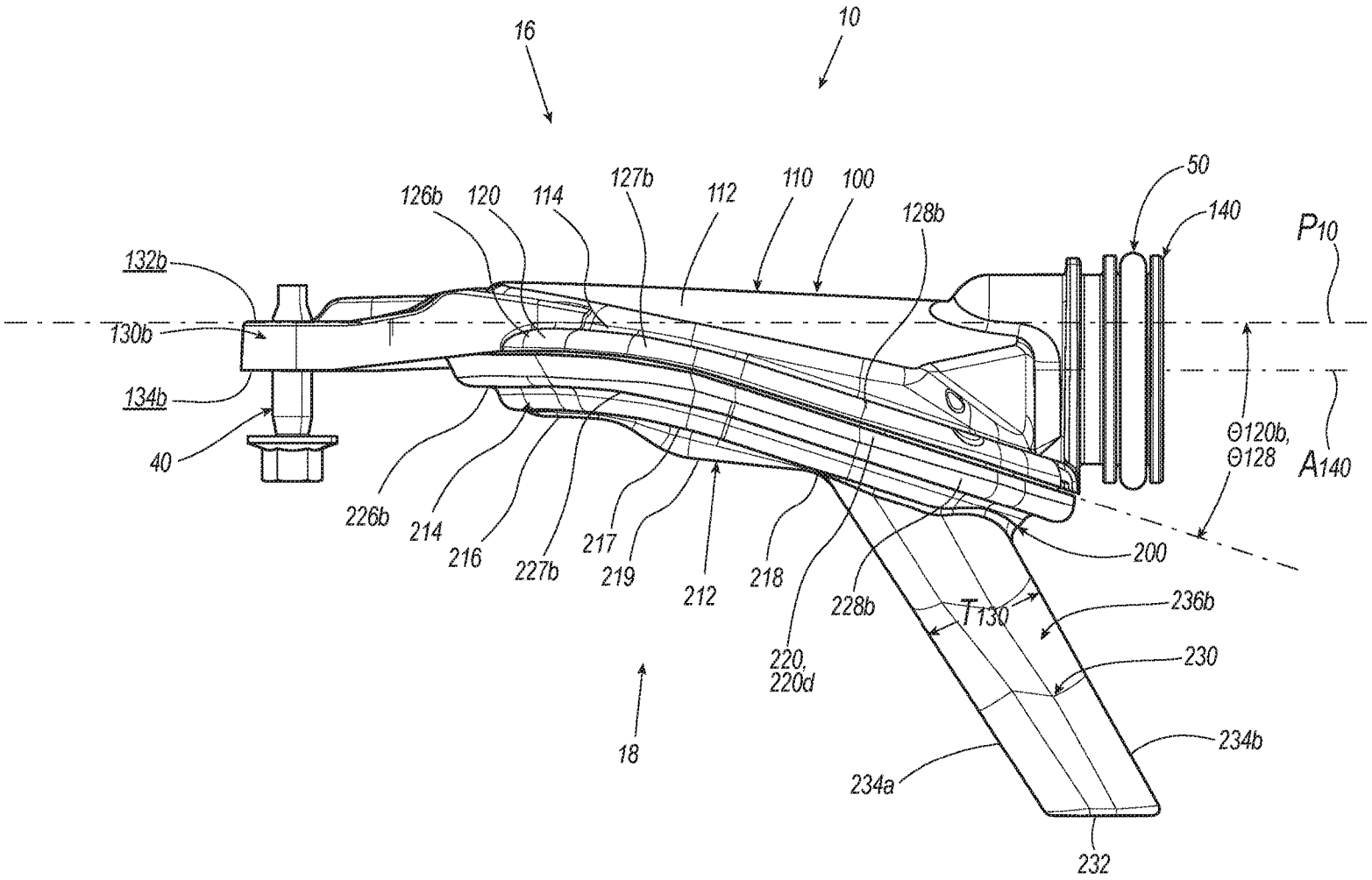
FIG. 8 is a left side elevation view of the oil pick-up assembly of FIG. 1.
Figure 9:
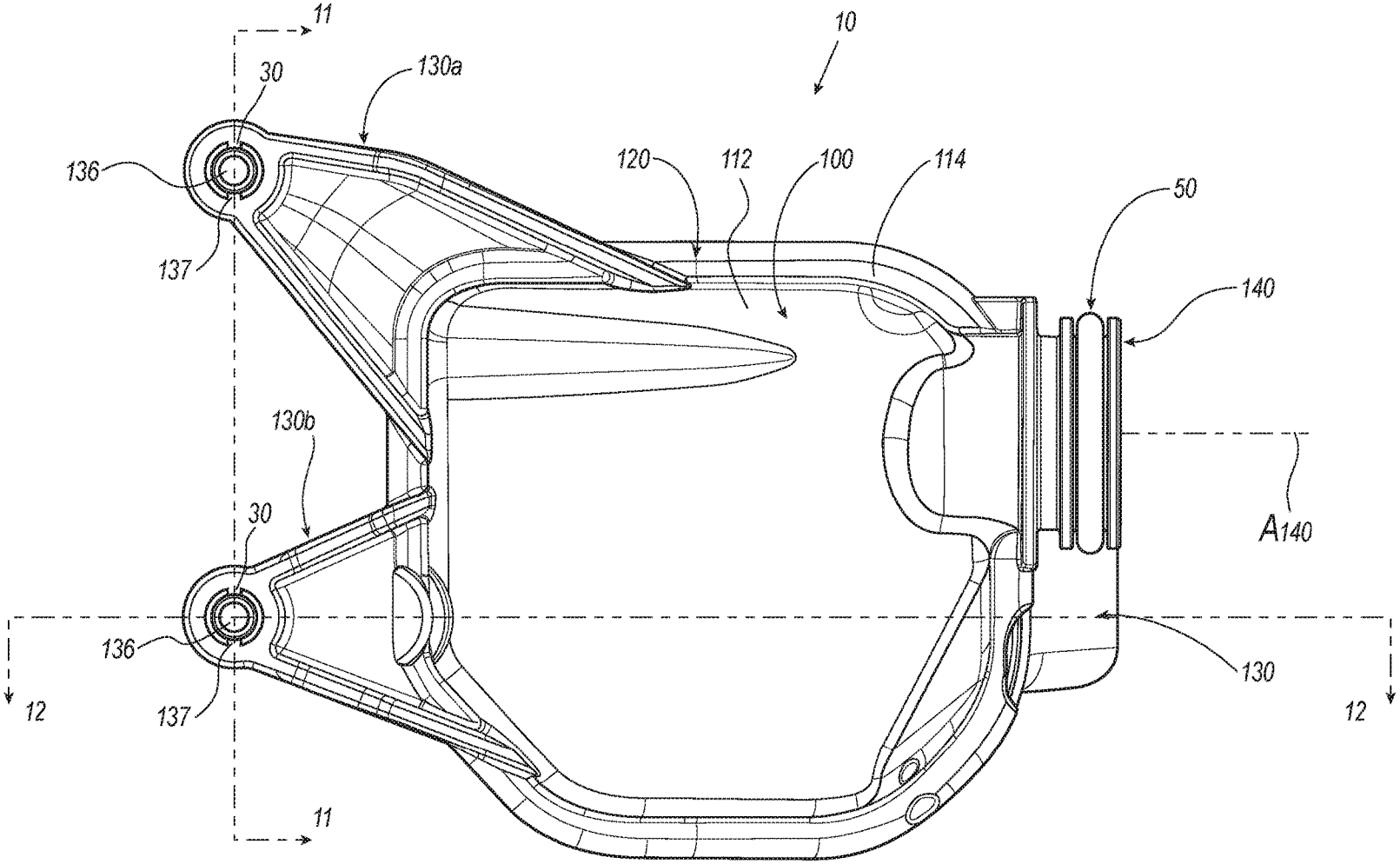
FIG. 9 is a top plan view of the oil pick-up assembly of FIG. 1.
Figure 10:
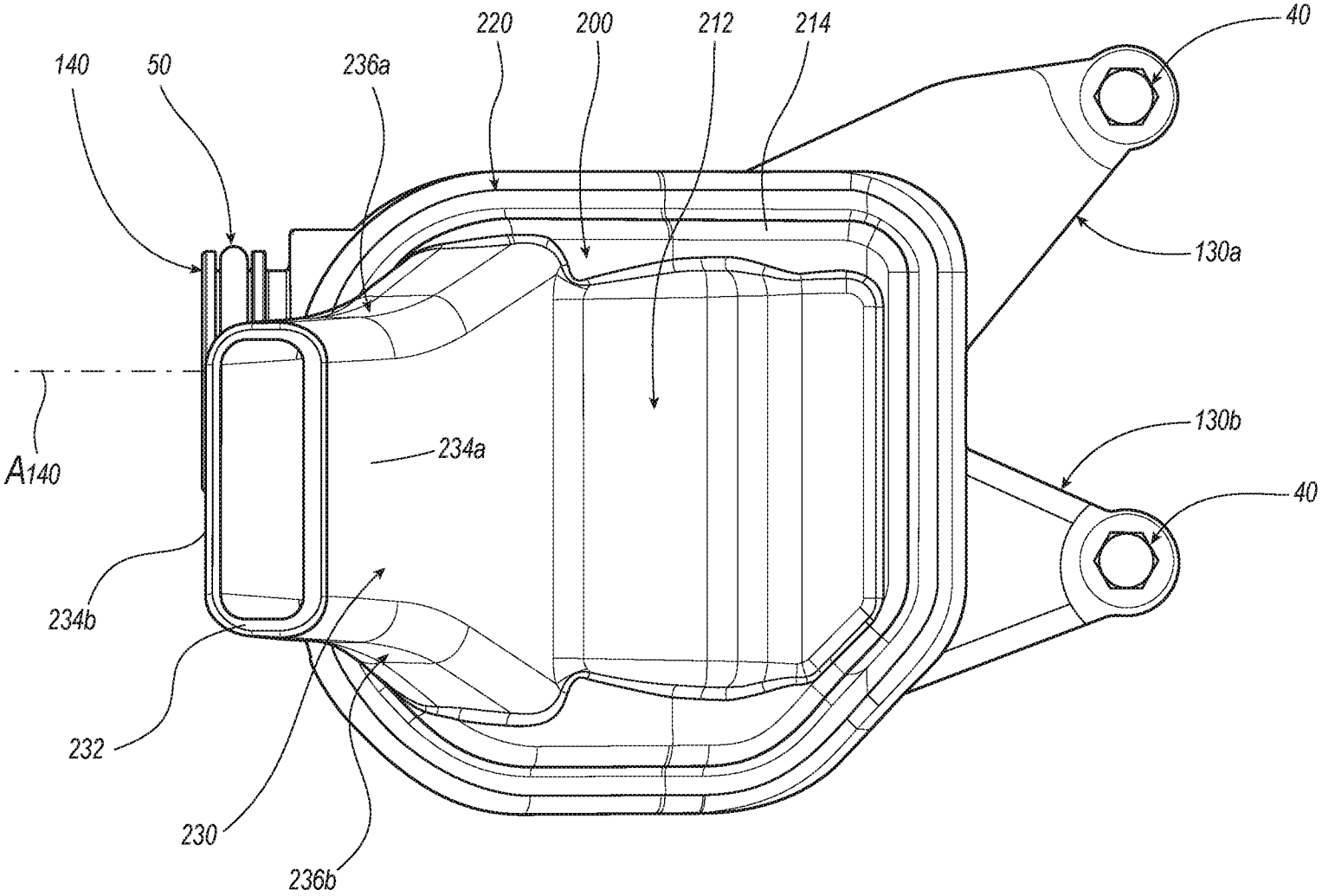
FIG. 10 is a bottom plan view of the oil pick-up assembly of FIG. 1.

The upper housing 100 includes an upper shell 110 forming a portion of the reservoir 20. An upper peripheral flange 120 extends along a lower portion of the upper shell 110 and defines an interface for attaching the upper housing 100 to the lower housing 200. One or more mounting tabs 130*a*, 130*b* extend from the upper shell 110 at the first end 12*a*, and are configured for attaching the assembly 10 to the engine. As shown in FIGS. 7 and 8, the mounting tabs 130*a*, 130*b* include a top surface 132*a*, 132*b* (FIG. 8) that define a reference mounting plane $P_{10}$ of the assembly 10. The upper housing 100 further includes an outlet tube 140 in communication with the reservoir 20 and extending from the upper shell 110 at the first end 12*a*. The outlet tube 140 includes a central axis $A_{140}$ that is substantially parallel to the mounting plane $P_{10}$ of the assembly 10.

Figure 2:
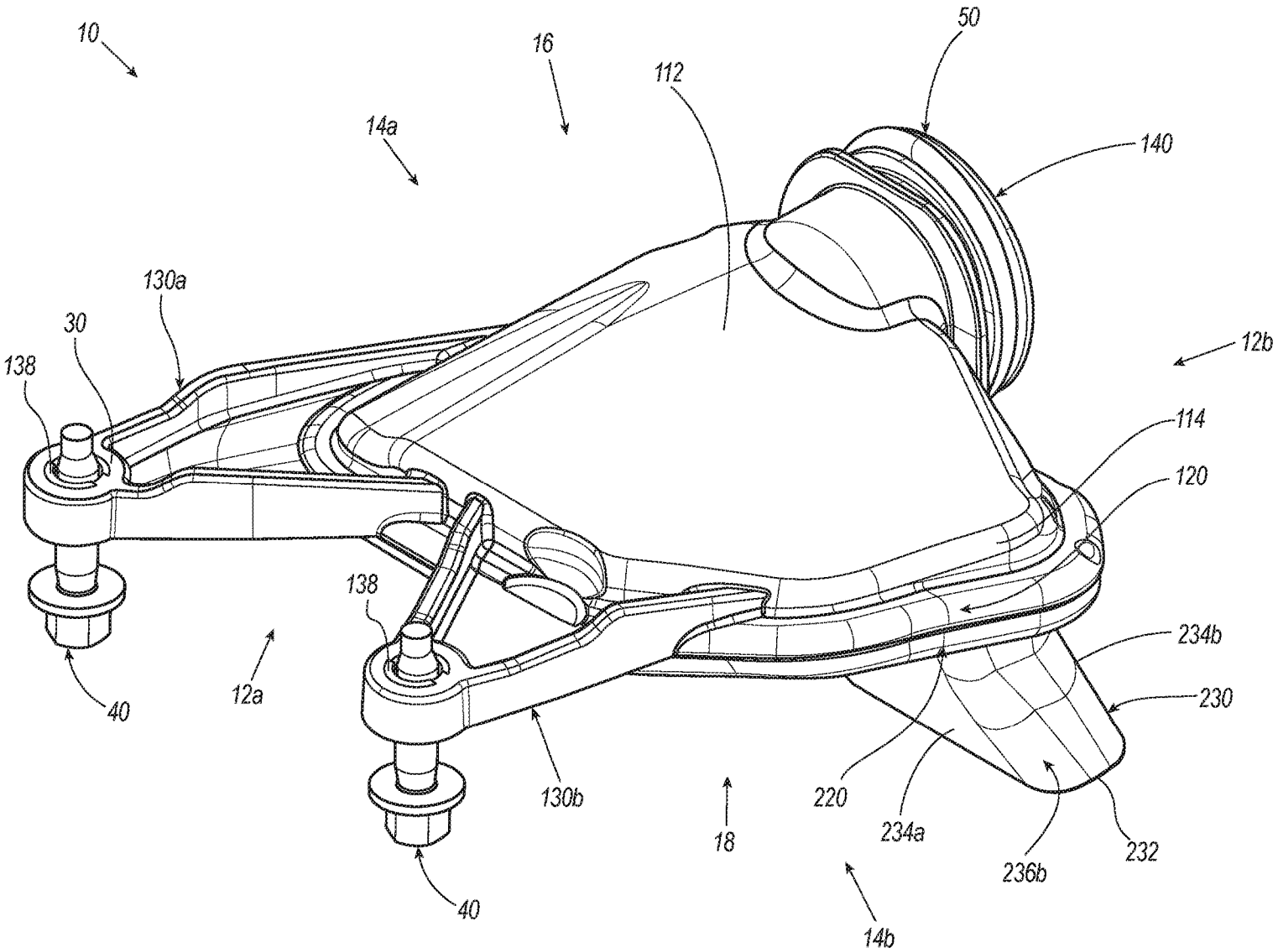
FIG. 2 is a top-front perspective view of the oil pick-up assembly of FIG. 1.
Figure 3:
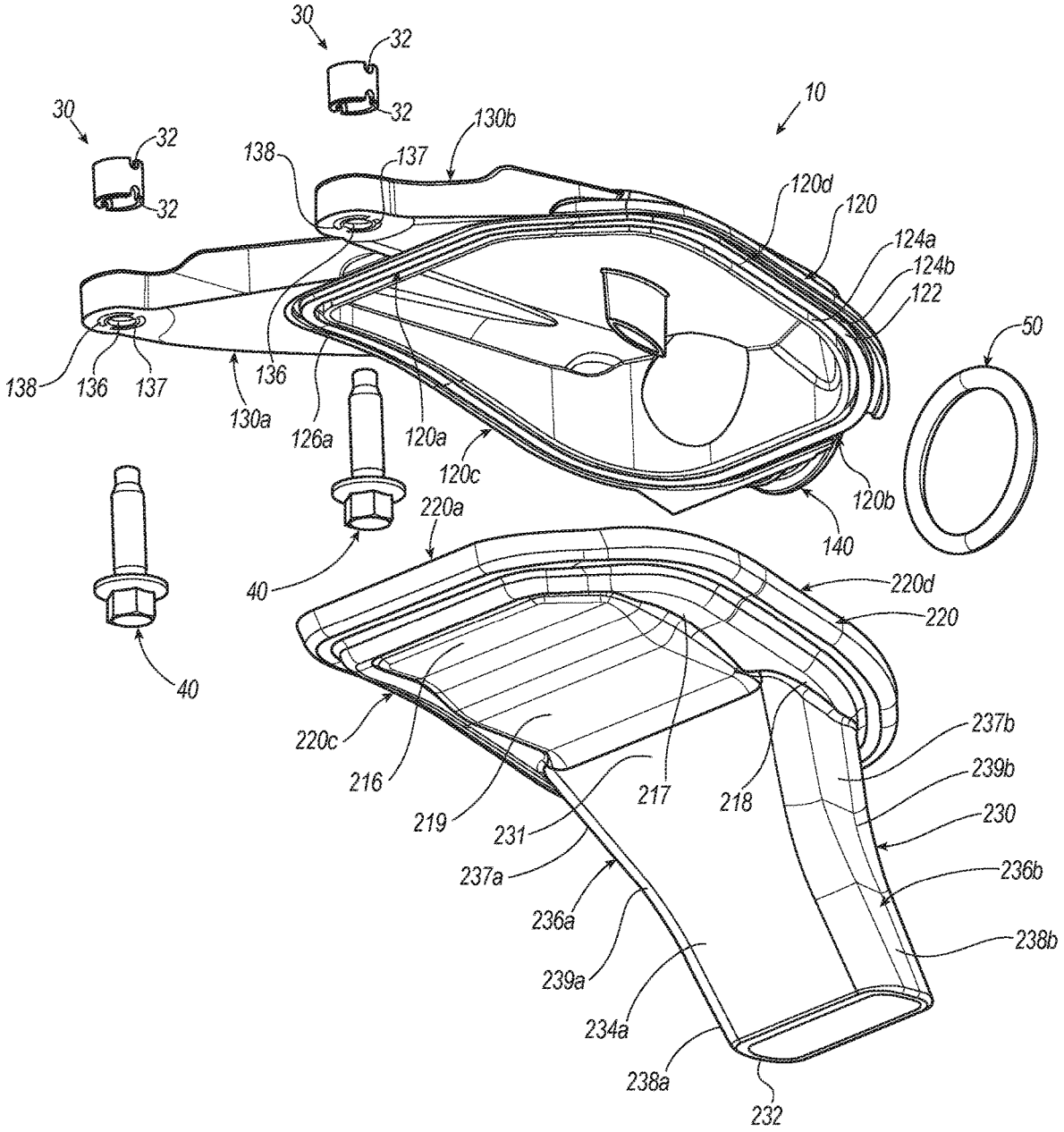
FIG. 3 is a bottom-front exploded perspective view of the oil pick-up assembly of FIG. 1.
Figure 4:
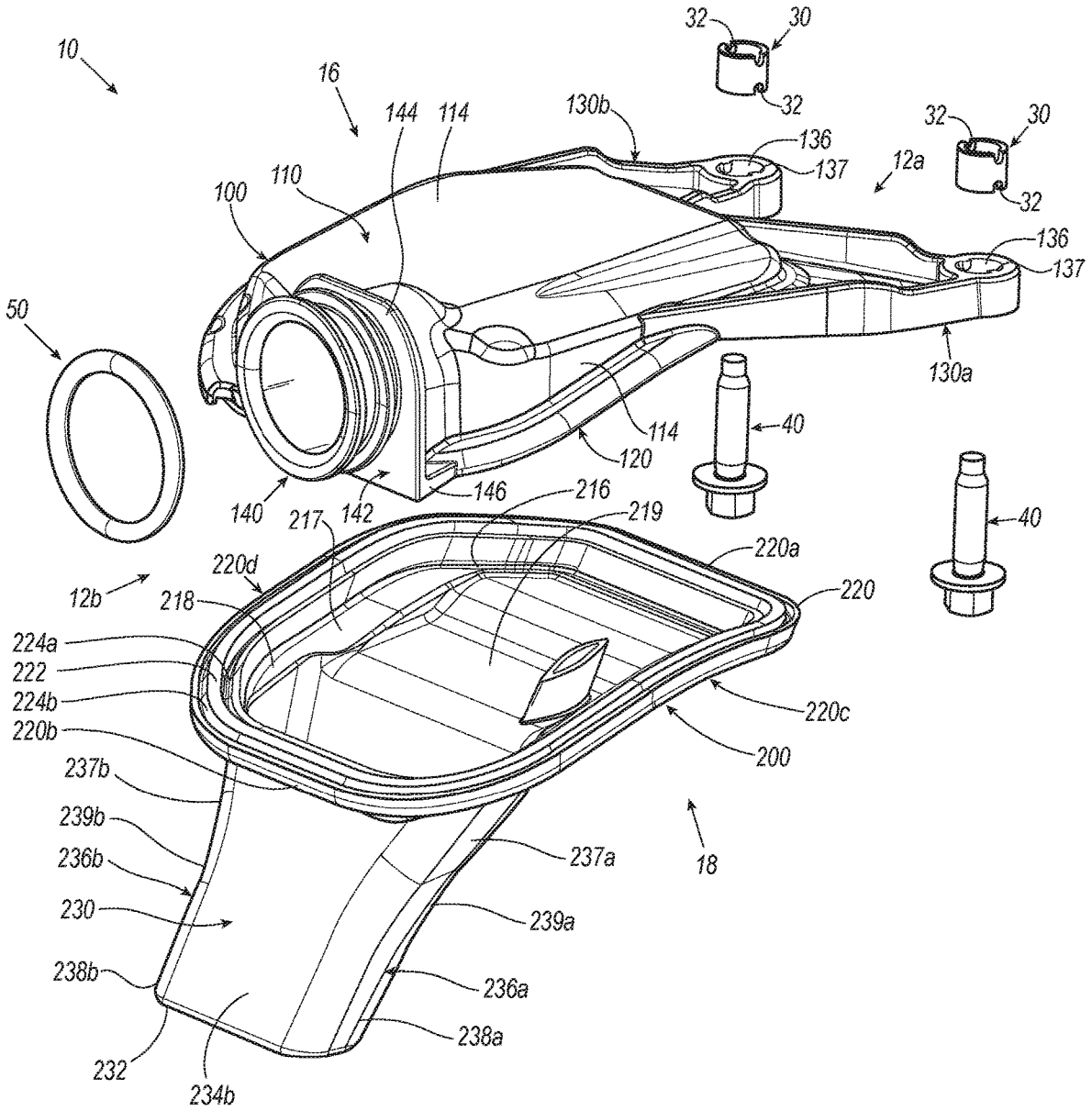
FIG. 4 is a top-rear exploded perspective view of the oil pick-up assembly of FIG. 1.

Referring to FIGS. 2-4, the upper shell 110 is defined by a top wall 112 and an upper peripheral wall 114. The top wall 112 may be flat or contoured and the upper peripheral wall 114 extends from the top wall 112 to a distal end at an opposite end of the peripheral wall 114 than the top wall 112. As shown, the peripheral wall 114 extends continuously around the outer periphery of the top wall 112. Thus, the peripheral wall 114 extends along each of the first end 12*a*, the second end 12*b*, the first side 14*a*, and the second side 14*b* of the assembly 10. The top wall 112 and the upper peripheral wall 114 cooperate to define an upper portion of the reservoir 20 of the pick-up assembly 10 when the upper housing 100 is assembled to the lower housing 200.

The upper housing 100 further includes an upper peripheral flange 120 projecting outwardly from the distal end of the upper peripheral wall 114 of the upper housing 100. The upper peripheral flange 120 includes an upper central rib 122 configured to function as a weld bead and a pair of continuous channels 124*a*, 124*b* extending along opposite sides of the upper central rib 122. The channels 124*a*, 124*b* act as flow regions for the material of the upper central rib 122 when upper central rib is softened during a welding process, as described in greater detail below. The upper central rib 122 may have a trapezoidal cross-sectional shape, whereby a width (i.e., the distance between channels 124*a*, 124*b*) of the upper central rib 122 tapers towards a distal end, allowing the central rib 122 to be more easily formed using a conventional molding process.

As best shown in FIG. 3, the lower peripheral flange 120 extends continuously around the upper housing 100. Specifically, the lower peripheral flange 120 includes a first end portion 120*a* extending along the first end 12*a*, a second end portion 120*b* extending along the second end 12*b*, a first side portion 120*c* extending along the first side 14*a*, and a second side portion 120*d* extending along the second side 14*b*.

As best shown in FIGS. 3, 7, and 8, each of the first side portion 120*c* and the second side portion 120*d* of the upper peripheral flange 120 include a first segment 126*a*, 126*b* disposed adjacent to the first end 12*a* and a second segment 128*a*, 128*b* disposed adjacent to the second end 12*b*. Generally, the first segments 126*a*, 126*b* of the side portions 120*c*, 120*d* extend substantially parallel to the mounting plane $P_{10}$ of the assembly 10, and the second segments 128*a*, 128*b* of the side portions 120*c*, 120*d* extend at an oblique angle $\theta_{128}$ relative to the mounting plane $P_{10}$ of the assembly 10. Accordingly, a of the peripheral wall 114 of the upper shell 110 increases along a direction of the second segments 128*a*, 128*b* towards the second end 12*b*. As shown, the first segments 126*a*, 126*b* may be connected to the respective second segments 128*a*, 128*b* by an arcuate intermediate segment 127*a*, 127*b* such that each side portion 120*c*, 120*d* of the upper peripheral flange 120 transitions from the first segments 126*a*, 126*b* to the second segment 128*a*, 128*b* along the arcuate intermediate segment 127*a*, 127*b*.

Figure 12:
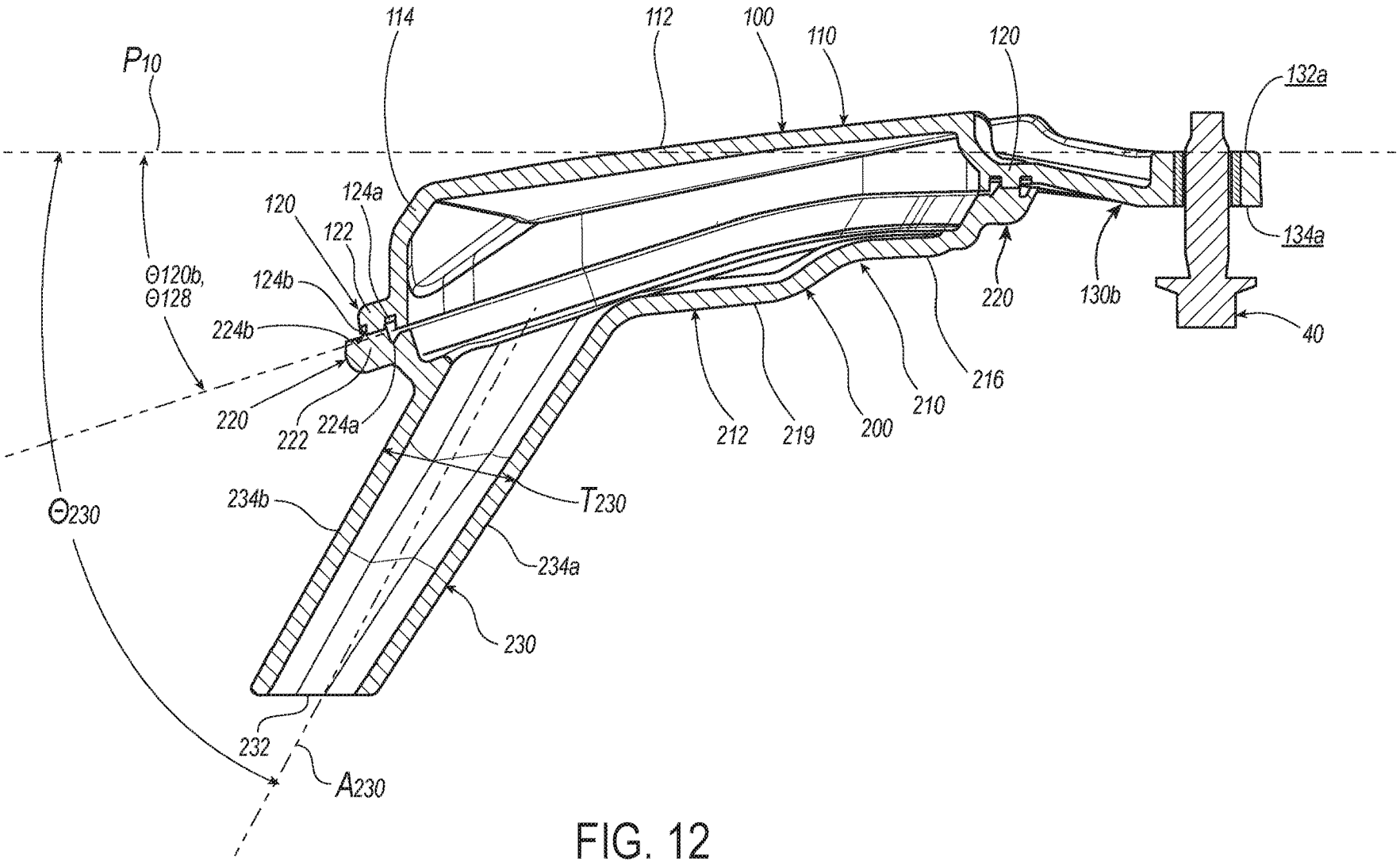
FIG. 12 is a cross-sectional view of the oil pick-up assembly of FIG. 1, taken along Line 12-12 of FIG. 9.

Referring to FIGS. 1, 4, and 12, the second end portion 120*b* of the upper peripheral flange 120, which extends along the second end 12*b* of the upper housing 100, extends from the upper shell 110 at an oblique angle $\theta_{120b}$ relative to the mounting plane $P_{10}$ of the assembly. Specifically, the second end portion 120*b* of the upper peripheral flange 120 extends at a downward angle $\theta_{120b}$ relative to the mounting plane $P_{10}$. In the illustrated example, the angle $\theta_{120b}$ of the second end portion 120*b* is substantially the same as the angle $\theta_{128}$ of the second segments 128*a*, 128*b* of the side portions 120*c*, 120*d* of the upper peripheral flange 120. More specifically, the second end portion 120*b* is coplanar with the angled second segments 128*a*, 128*b*.

As introduced previously, the upper housing 100 includes a pair of the mounting tabs 130*a*, 130*b* each extending from the peripheral wall 114 at the first end 12*a*. Each mounting tab 130*a*, 130*b* includes a top surface 132*a*, 132*b* that cooperate to define the mounting plane $P_{10}$ of the assembly 10. Each tab 130*a*, 130*b* also includes a respective bottom surface 134*a*, 134*b* formed on an opposite side from the top surface 132*a*, 132*b*, where a distance from the top surface 132*a*, 132*b* to the bottom surface 134*a*, 134*b* defines a thickness of each mounting tab 130*a*, 130*b*.

Figure 11:
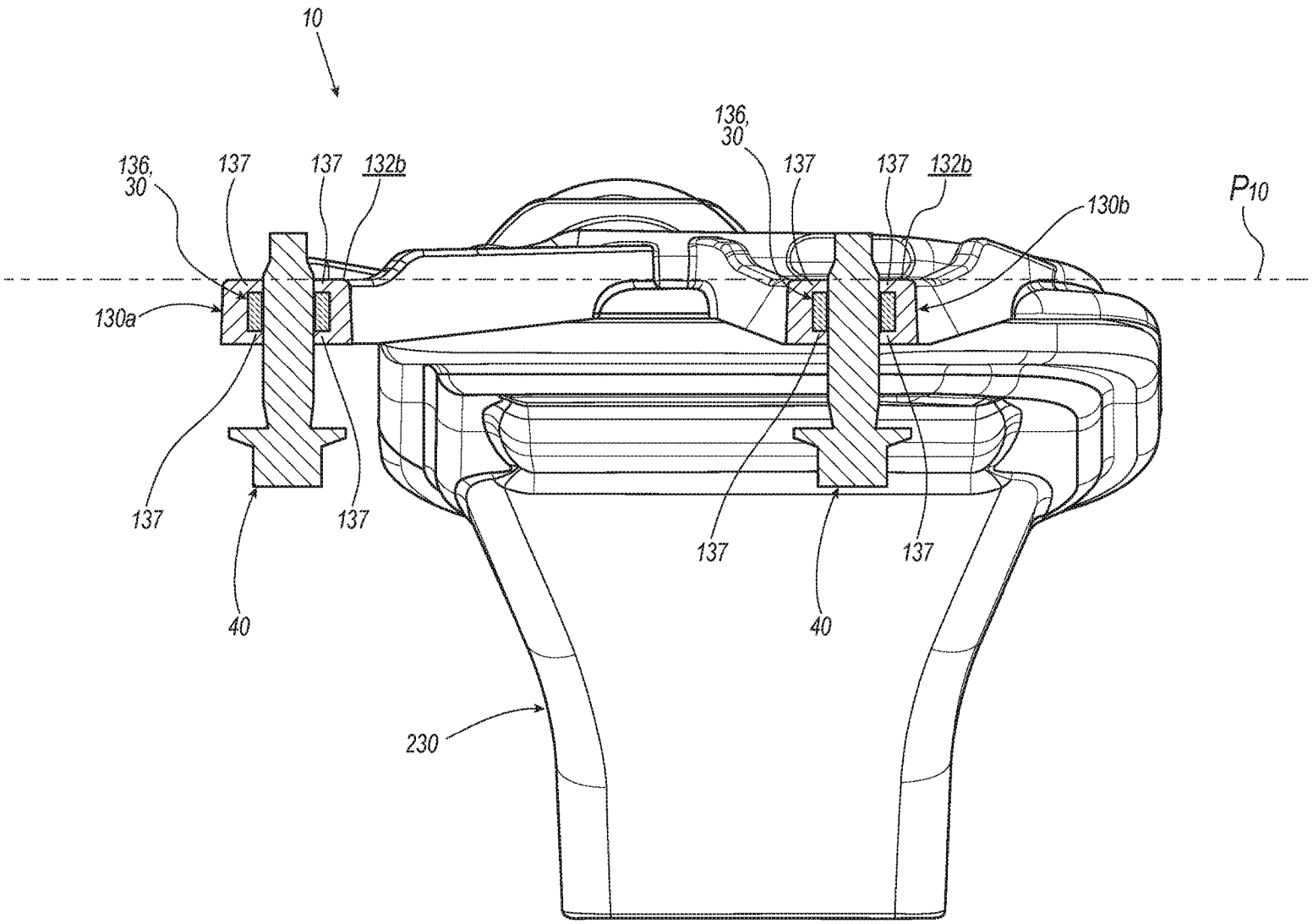
FIG. 11 is a cross-sectional view of the oil pick-up assembly of FIG. 1, taken along Line 11-11 of FIG. 9.

Each of the mounting tabs 130*a*, 130*b* includes an aperture 136 extending through the thickness of the mounting tab 130*a*, 130*b*. Each aperture 136 is configured to receive a compression-limiting bushing 30 and a fastener 40 for attaching the assembly 10 to a corresponding mounting interface of the engine. As shown in FIG. 11, each of the mounting tabs 130*a*, 130*b* may include a pair of protuberances 137 projecting radially inwardly into the aperture 136 adjacent to each of the top surface 132*a*, 132*b* and the bottom surface 134*a*, 134*b*. Thus, each aperture 136 includes a pair of the protuberances 137 at a first end and a pair of the protuberances 137 at a second end. The protuberances 137 interface with corresponding notches 32 formed in ends of the compression-limiting bushing 30 to prevent axial and rotational movement of the bushing 30 within the aperture 136. Details of the compression-limiting bushing 30 can be found in co-pending application Ser. No. 17/000,670 titled "Compression Limiter", filed on Aug. 24, 2020, the contents of which are hereby incorporated by reference in their entirety.

Each mounting tab 130*a*, 130*b* may also include a fastener retainer 138 integrally molded at one end of the aperture 136. As best shown in FIG. 3, the retainer 138 is formed as ring connecting opposing ends of the protuberances 137 adjacent to the bottom surface 134*a*, 134*b*. The retainer ring 138 has an inside diameter that is less than a major diameter of a threaded portion of the fastener 40 such that the fastener 40 can be threaded through the retainer ring 138. Thus, the retainer ring 138 is configured to hold the fastener 40 captive within the aperture 136 during handling and storage of the assembly 10, prior to installation on the engine. The retainer ring 138 is formed of a relatively soft material, such that when the assembly 10 is attached to the engine and the fasteners 40 are torqued, threads of the fastener 40 will strip the interior diameter of the retainer ring 138 to allow the fastener 40 to rotate freely relative to the retainer ring 138 and the mounting tabs 130*a*, 130*b*.

The compression limiter 30 is disposed within the aperture 136 of each mounting tab 130*a*, 130*b*. As best shown in FIG. 3, the compression limiter 30 is a tubular body having an outside diameter corresponding to an inside diameter of the aperture 136 and an inside diameter configured as a clearance hole for the fastener 40. Each end of the compression limiter 30 includes a pair of notches 32, which—as discuss previously—cooperate with the protuberances 137 of each mounting tab 130*a*, 130*b* to secure the axial and rotational position of the compression limiter 30 within the respective mounting tab 130*a*, 130*b*. In some examples, the compression limiter 30 may be co-molded with the upper housing 100 in a molding process (e.g., injection molding), whereby the protuberances 137 are formed as the molding material flows into the notches 32 of the compression limiter 30.

The outlet tube 140 of the upper housing 100 extends from the second end 12*b* along the central axis $A_{140}$. As discussed previously, the central axis $A_{140}$ of the outlet tube 140 is parallel to the mounting plane $P_{10}$ of the housing. The outlet tube 140 may include one or more grooves for receiving an o-ring 50. As shown in FIGS. 1, 7, and 8 the outlet tube 140 may include a support ring 142 connecting the outlet tube 140 to the upper peripheral flange 120. The support ring 142 includes an annular portion 144 surrounding the outlet tube 140 and a lower leg 146 attached to the second end portion 120*b* of the upper peripheral flange 120.

The lower housing 200 includes a lower shell 210 forming a lower portion of the reservoir 20. A lower peripheral flange 220 extends along an upper portion of the lower shell 210 and defines an interface for attaching the lower housing 200 to the upper housing 100. The lower housing 200 further includes a pick-up or inlet tube 230 extending along a longitudinal axis $A_{230}$ from the lower shell 210 at an oblique angle $\theta_{230}$ relative to the mounting plane $P_{10}$ of the assembly 10.

Referring to FIGS. 1, 3, and 4, the lower shell 210 is defined by a bottom wall 212 and a lower peripheral wall 214. The bottom wall 212 may be flat or contoured and the lower peripheral wall 214 extends from the bottom wall 212 to a distal end at an opposite end of the lower peripheral wall 214 than the bottom wall 212. As shown, the lower peripheral wall 214 extends continuously around the outer periphery of the bottom wall 212. Thus, the lower peripheral wall 214 extends along each of the first end 12*a*, the second end 12*b*, the first side 14*a*, and the second side 14*b* of the assembly 10. The bottom wall 212 and the lower peripheral wall 214 cooperate to define a lower portion of the reservoir 20 of the pick-up assembly 10 when the lower housing 200 is assembled to the upper housing 100.

The lower housing 200 further includes a lower peripheral flange 220 projecting outwardly from the distal end of the lower peripheral wall 214 of the lower housing 200. The lower peripheral flange 220 includes a lower central rib 222 configured to function as a weld bead and a pair of continuous channels 224*a*, 224*b* extending along opposite sides of the lower central rib 222. The channels 224*a*, 224*b* act as flow regions for the material of the lower central rib 222 when lower central rib 222 is softened during a welding process, as described in greater detail below. The lower central rib 222 may have a trapezoidal cross-sectional shape, whereby a width of the lower central rib 222 (i.e., a distance between the channels 224*a*, 224*b*) tapers towards a distal end, allowing the central rib 222 to be more easily formed using a conventional molding process.

As best shown in FIG. 4, the lower peripheral flange 220 extends continuously around the lower housing 200. Specifically, the lower peripheral flange 220 includes a first end portion 220*a* extending along the first end 12*a*, a second end portion 220*b* extending along the second end 12*b*, a first side portion 220*c* extending along the first side 14*a*, and a second side portion 220*d* extending along the second side 14*b*. As best shown in FIGS. 7 and 8, each of the first side portion 220*c* and the second side portion 220*d* of the lower peripheral flange 220 include a first segment 226*a*, 226*b* disposed adjacent to the first end 12*a* and a second segment 228*a*, 228*b* disposed adjacent to the second end 12*b*. Generally, the first segments 226*a*, 226*b* of the side portions 220*c*, 220*d* extend substantially parallel to the mounting plane $P_{10}$ of the assembly 10, and the second segments 228*a*, 228*b* of the side portions 220*c*, 220*d* extend at the oblique angle $\theta_{128}$ relative to the mounting plane $P_{10}$ of the assembly 10. As shown, the first segments 226*a*, 226*b* may be connected to the respective second segments 228*a*, 228*b* by an arcuate intermediate segment 227*a*, 227*b* such that each side portion 220*c*, 220*d* of the lower peripheral flange 220 transitions from the first segments 226*a*, 226*b* to the second segment 228*a*, 228*b* along the arcuate intermediate segment 227*a*, 227*b*. Accordingly, the segments 226*a*, 226*b*, 227*a*, 227*b*, 228*a*, 228*b* of the lower peripheral flange 220 are configured to interface with the segments 126*a*, 126*b*, 127*a*, 127*b*, 128*a*, 128*b* of the upper peripheral flange 120 to attach the lower housing 200 to the upper housing 100.

Referring to FIGS. 7, 8, and 12, the second end portion 220*b* of the lower peripheral flange 220, which extends along the second end 12*b* of the lower housing 200, extends from the lower shell 210 at the oblique angle $\theta_{120b}$ relative to the mounting plane $P_{10}$ of the assembly. Specifically, the second end portion 220*b* of the lower peripheral flange 220 extends at a downward angle $\theta_{120b}$ relative to the mounting plane $P_{10}$. In the illustrated example, the angle $\theta_{220b}$ of the second end portion 220*b* is substantially the same as the angle $\theta_{128}$ of the second segments 228*a*, 228*b* of the side portions 220*c*, 220*d* of the lower peripheral flange 220. More specifically, the second end portion 220*b* is coplanar with the second segments 228*c*, 228*d*.

During assembly of the upper and lower housings 100, 200, the upper central rib 122 of the upper peripheral flange 120 is aligned with the lower central rib 222 of the lower peripheral flange 220. The central ribs 122, 222 are then subjected to a polymer welding process, such as an infrared or ultrasonic welding process, to join the upper central rib 122 to the lower central rib 222 along the entire periphery of the reservoir 20. During the welding process, the materials of the upper and lower central ribs 122, 222 flow into the adjacent channels 124*a*, 124*b*, 224*a*, 224*b* as the upper and lower peripheral flanges 120, 220 are pressed together.

Unlike the upper housing 100, which has an increasing height corresponding to the bend and angle of the side portions 120*c*, 120*d*, the lower housing 200 has a substantially constant height. Accordingly, the bottom wall 212 of the lower housing 200 has a profile corresponding to the path of the side portions 220*c*, 220*d* of the lower peripheral flange 220. For example, the bottom wall 212 includes a first segment 216 disposed adjacent to the first end 12*a* that is substantially parallel to the mounting plane $P_{10}$. Additionally, the bottom wall 212 includes a second segment 218 disposed at the second end 12*b* and extending at the same angle $\theta_{128}$ as the second segments 128, 228 of the peripheral flanges 120, 220. The first and second segments are connected by an arcuate intermediate segment 217, which may include an intermediate stepped portion 219. This bent or curved profile of the bottom wall 212 provides the lower housing 200 with an initial transition into the deeper well portion of an oil pan within which the pick-up assembly may be installed.

The lower housing 200 further includes an inlet tube 230 extending continuously from a proximal end 231 attached to the second segment 218 of the bottom wall 212 to a terminal distal end 232. The inlet tube 230 includes a pair of end walls 234*a*, 234*b* and a pair of sidewalls 236*a*, 236*b*. A first one of the end walls 234*a* extends from the second segment 218 of the bottom wall 212 adjacent to the intermediate segment 217 and a second one of the end walls 234*b* extends from the second segment 218 of the bottom wall 212 adjacent to the second end portion 220*b* of the lower peripheral flange 220. As shown, each of the end walls 234*a*, 234*b* is flat, such that the inlet tube 230 extends along a straight longitudinal axis $A_{230}$ from the bottom wall 212 to the distal end 232. The longitudinal axis $A_{230}$ is oriented at an oblique angle $\theta_{230}$ that is greater than the angle $\theta_{128}$ of the second segment 218 of the bottom wall 212. Accordingly, the second segment 218 of the bottom wall 212 and the inlet tube 230 cooperate to provide a compound bend around a transition point of an oil pan (i.e., the transition between the shallow portion and the sump of the pan)

A distance from the first end wall 234*a* to the second end wall 234*b* defines a thickness $T_{130}$ of the inlet tube 230. In the illustrated example, each of the end walls 234*a*, 234*b* is straight along the entire length of the inlet tube 230 from the bottom wall 212 to the distal end 232 of the inlet tube 230. However, the thickness $T_{130}$ of the inlet tube 230 tapers constantly and continuously as the end walls 234*a*, 234*b* converge with each other along the direction from the bottom wall 212 to the distal end 232.

Figure 5:
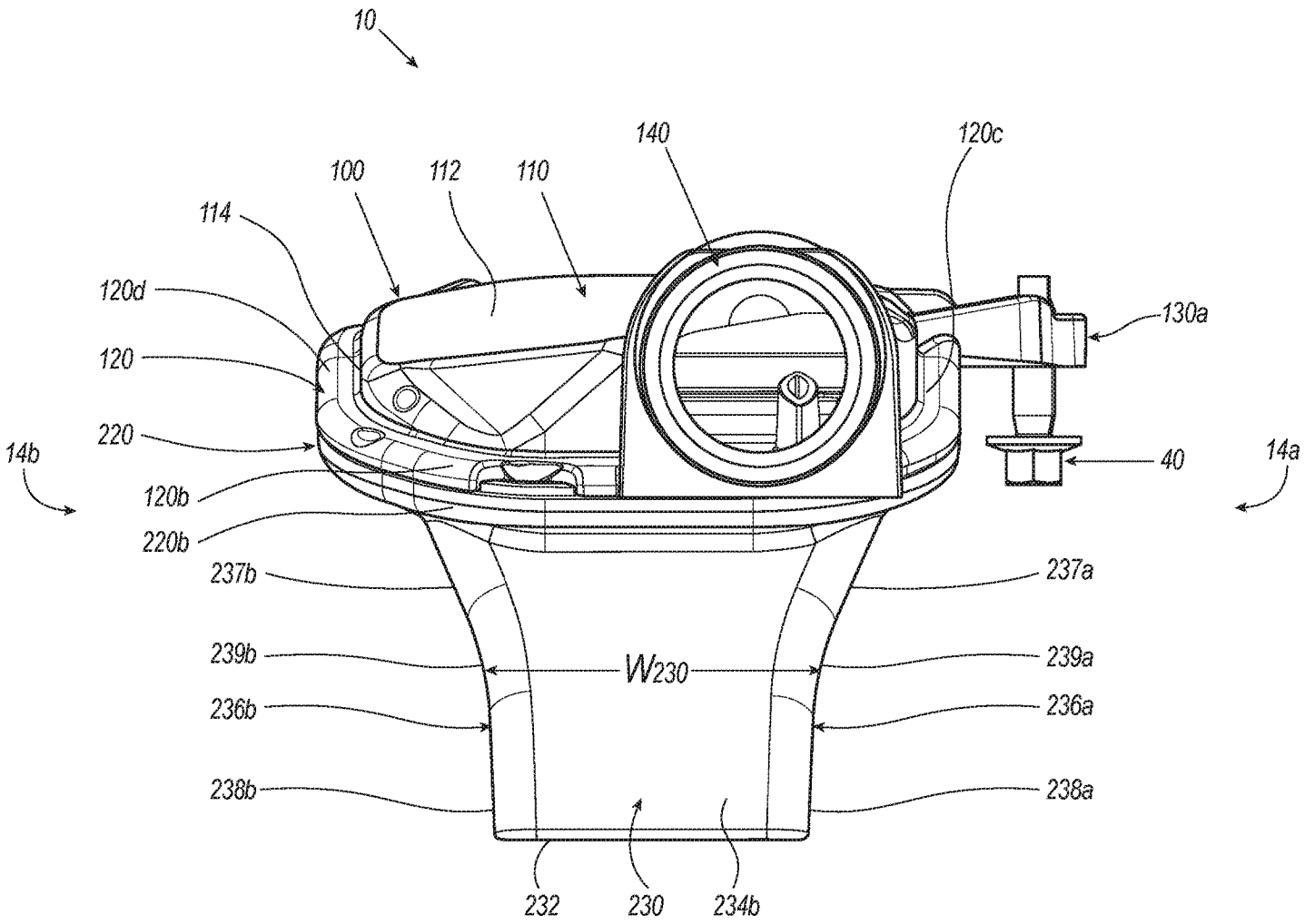
FIG. 5 is a rear elevation view of the oil pick-up assembly of FIG. 1.
Figure 6:
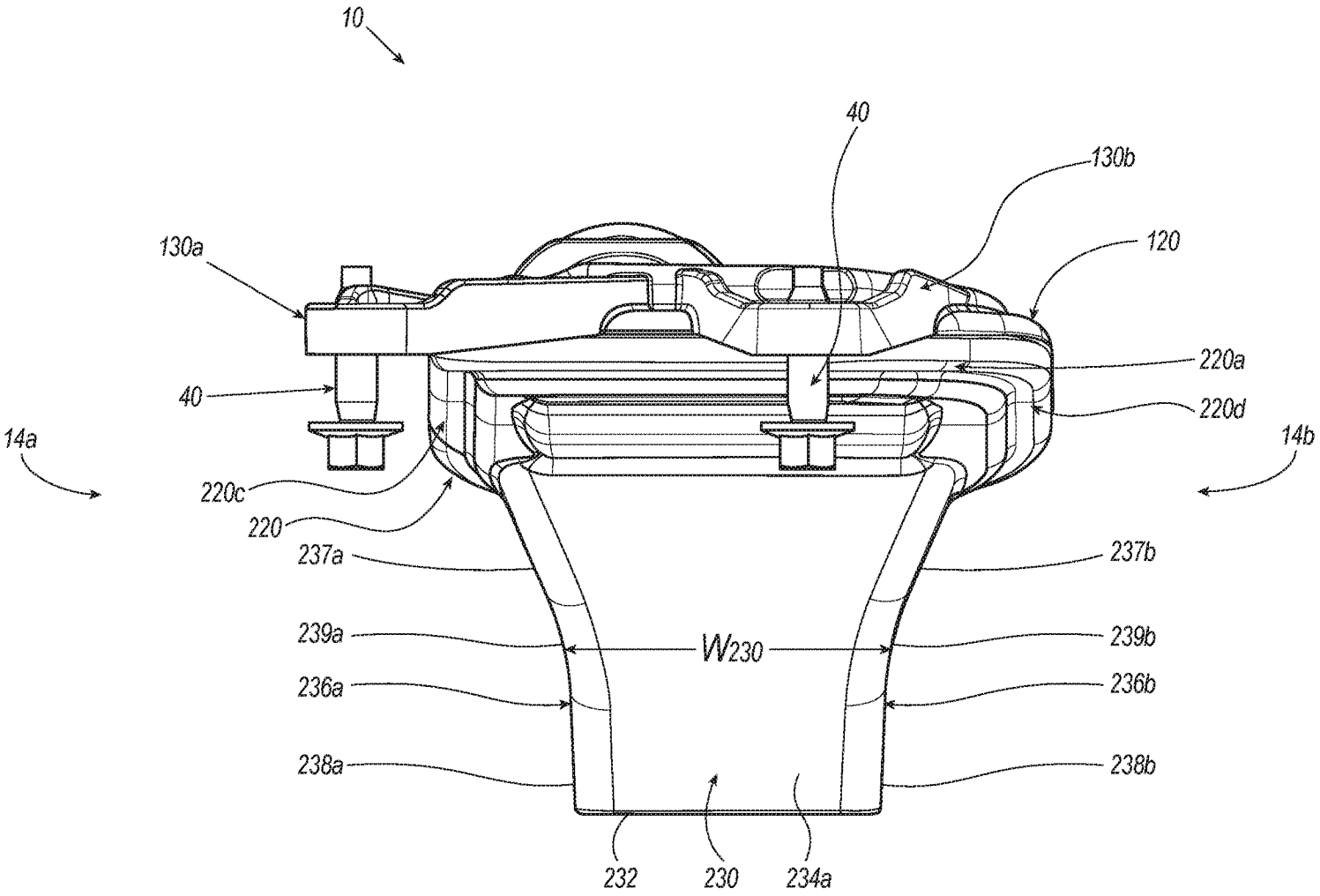
FIG. 6 is a front elevation view of the oil pick-up assembly of FIG. 1.

As best shown in FIGS. 5 and 6, the sidewalls 236*a*, 236*b* of the inlet tube 230 include a first sidewall 236*a* connecting the end walls 234*a*, 234*b* on a first side 14*a* of the inlet tube 230 and a second sidewall 236*b* connecting the end walls on an opposite second side 14*b* of the inlet tube 230. A distance from the first sidewall 236*a* to the second sidewall 236*b* defines a width $W_{230}$ of the inlet tube 230. As shown, the sidewalls 236*a*, 236*b* may each include an upper portion 237*a*, 237*b* extending from the bottom wall 212 and a lower portion 238*a*, 238*b* extending from the upper portion 237*a*, 237*b* to the distal end 232. The upper portions 237*a*, 237*b* converge with each other at a first rate and the lower portions 238*a*, 238*b* converge with each other at a second rate along the length of the inlet tube 230. Accordingly, the width $W_{230}$ of the inlet tube 230 tapers at the first rate along the upper portions 237*a*, 237*b* and the width $W_{230}$ of the inlet tube 230 tapers at a more gradual second rate along the lower portions 238*a*, 238*b* of the inlet tube 230. The upper portions 237*a*, 237*b* and the lower portions 238*a*, 238*b* are connected to each other by an arcuate intermediate portion 239*a*, 239*b*.

By forming the inlet tube with the straight end walls 234*a*, 234*b* and the converging sidewalls 236*a*, 236*b* in combination with the bent bottom wall 212, the lower housing 200 can be formed in an injection molding process using conventional, stationary tooling. In other words, the geometries of the bottom wall 212 and the inlet tube 230 are configured such that the lower housing 200 can be removed from a mold without requiring portions of the mold to move relative to each other. This advantageously minimizes mold complexity and costs associated with designing and manufacturing the mold. While minimizing mold complexity, the design of the present disclosure also provides improved functional benefits. For example, the bent bottom wall 212 and the angled inlet tube 230 cooperate to bend around a transition of an oil pan, such that the mounting tabs 130*a*, 130*b* and the first end 12*a* of the assembly 10 fit within a shallow portion of the oil pan while the second end 12*b* and the inlet tube 230 extend into the deeper sump portion of the oil pan to maintain constant a submersion within the oil supply contained in the oil pan.

A number of implementations have been described. Nevertheless, it will be understood that various modifications may be made without departing from the spirit and scope of the disclosure. Accordingly, other implementations are within the scope of the following claims.

What is claimed is:

1. An oil pick-up assembly for a motor vehicle, the oil pick-up assembly comprising:

an upper housing comprising:

an upper shell extending from a first end of the assembly to a second end of the assembly, the upper shell defining a mounting plane of the assembly;

an outlet tube extending from the second end, the outlet tube having a central axis that is parallel to the mounting plane; and an upper peripheral flange surrounding the upper shell; and a lower housing comprising:

a lower shell extending from the first end of the assembly to the second end of the assembly, the lower shell including a first portion adjacent to the first end and substantially parallel to the mounting plane and a second portion adjacent to the second end and formed at a first oblique angle relative to the mounting plane; and a lower peripheral flange surrounding the lower shell, the lower peripheral flange attached to the upper peripheral flange of the upper housing to form a chamber.

2. The oil pick-up assembly of claim 1, wherein the lower housing comprises a pick-up tube extending from the second portion at a second oblique angle relative to the mounting plane.

3. The oil pick-up assembly of claim 2, wherein the pick-up tube extends continuously along a longitudinal axis extending from a proximal end connected to the second portion of the lower shell to a distal end.

4. The oil pick-up assembly of claim 3, wherein the pick-up tube tapers from the first end to the second end.

5. The oil pick-up assembly of claim 1, wherein the first portion of the lower shell is connected to the second portion of the lower shell by an arcuate intermediate portion.

6. The oil pick-up assembly of claim 1, wherein a portion of the upper peripheral flange that surrounds the upper shell extends along the second end of the assembly at a third oblique angle relative to the mounting plane.

7. The oil pick-up assembly of claim 6, wherein a value of the third oblique angle is the same as a value of the first oblique angle.

8. The oil pick-up assembly of claim 1, wherein the upper peripheral flange is welded to the lower peripheral flange.

9. The oil pick-up assembly of claim 1, wherein the upper housing comprises at least one mounting tab extending from the upper shell, the at least one mounting tab including a mounting surface defining the mounting plane of the upper housing.

10. A method of manufacturing an oil pick-up assembly for a motor vehicle, the method comprising the steps of:

forming an upper housing including an upper shell extending from a first end of the assembly to a second end of the assembly and an upper peripheral flange surrounding the upper shell, the upper shell defining a mounting plane of the assembly and an outlet tube extending from the second end, the outlet tube having a central axis that is parallel to the mounting plane;

forming a lower housing including a lower shell extending from the first end to the second end and a lower peripheral flange surrounding the lower shell, wherein:

the lower peripheral flange of the lower housing is attached to the upper peripheral flange of the upper housing to form a chamber; and the lower shell comprises a first portion adjacent to the first end and substantially parallel to the mounting plane, and a second portion adjacent to the second end and formed at a first oblique angle relative to the mounting plane; and attaching the upper peripheral flange of the upper housing to the lower peripheral flange of the lower housing.

11. The method of claim 10, wherein forming the lower housing comprises forming a pick-up tube extending from the second portion at a second oblique angle relative to the mounting plane.

12. The method of claim 11, wherein forming the pick-up tube comprises extending the pick-up tube continuously along a longitudinal axis from a proximal end connected to the second portion of the lower shell to a terminal distal end.

13. The method of claim 12, wherein forming the pick-up tube comprises tapering the pick-up tube.

14. The method of claim 10, wherein forming the lower shell comprises forming an arcuate intermediate portion connecting the first portion of the lower shell to the second portion of the lower shell.

15. The method of claim 10, wherein forming the upper housing comprises forming a portion of the upper peripheral flange that surrounds the upper shell to extend along the second end of the assembly at a third oblique angle relative to the mounting plane.

16. The method of claim 15, wherein a value of the third oblique angle is the same as a value of the first oblique angle.

17. The method of claim 10, wherein attaching the upper peripheral flange of the upper housing to the lower peripheral flange of the lower housing comprises welding the upper peripheral flange to the lower peripheral flange.

18. The method of claim 10, wherein forming the upper housing comprises:

forming at least one mounting tab extending from the upper shell; and forming the at least one mounting tab with a mounting surface defining the mounting plane of the upper housing.

* * * * *